US005366013A

United States Patent [19]

Edwards et al.

[11] Patent Number: 5,366,013

[45] Date of Patent: Nov. 22, 1994

[54] SHOCK ABSORBER FOR USE IN A WELLBORE INCLUDING A FRANGIBLE BREAKUP ELEMENT PREVENTING SHOCK ABSORPTION BEFORE SHATTERING ALLOWING SHOCK ABSORPTION AFTER SHATTERING

[75] Inventors: A. Glen Edwards, Hockley; Joe C. Hromas; Klaus B. Huber, both of Sugarland; Edward G. Smith, Jr., San Leon, all of Tex.

[73] Assignee: Schlumberger Technology Corporation, Houston, Tex.

[21] Appl. No.: 57,948

[22] Filed: May 5, 1993

Related U.S. Application Data

[63] Continuation-in-part of Ser. No. 955,816, Oct. 2, 1992, Pat. No. 5,318,126, which is a continuation-in-part of Ser. No. 858,400, Mar. 26, 1992, abandoned, which is a continuation of Ser. No. 32,817, May 16, 1993, Pat. No. 5,293,940.

[51] Int. Cl.[5] ..... E21B 43/116

[52] U.S. Cl. ..... 166/297; 166/55.1

[58] Field of Search ..... 166/55.1, 297, 63, 299; 175/4.54, 4.52, 4.56, 2

[56] References Cited

U.S. PATENT DOCUMENTS

| | | | |
|---|---|---|---|
| 2,725,940 | 12/1955 | Shidell et al. | 166/169 X |
| 3,163,112 | 12/1964 | Rhea | 166/297 X |
| 3,311,178 | 3/1967 | McElheny | 175/4.54 |
| 3,923,105 | 12/1975 | Lands, Jr. | 166/55.1 X |
| 3,923,106 | 12/1975 | Bosse-Platiere | 166/55.1 X |
| 4,693,317 | 9/1987 | Edwards et al. | 166/378 |
| 4,817,710 | 4/1989 | Edwards et al. | 166/242 |
| 5,088,557 | 2/1992 | Rieles et al. | 175/4.54 X |
| 5,131,470 | 7/1992 | Miszewski et al. | 166/297 |

*Primary Examiner*—Hoang C. Dang

*Attorney, Agent, or Firm*—Henry N. Garrana; John H. Bouchard

[57] ABSTRACT

A shock absorber, adapted to be disposed above a perforating gun in a tool string and adapted to be disposed in a wellbore, includes a crushable element disposed between an inner and outer housing, a frangible breakup element, and a detonating cord disposed within the frangible breakup element and connected to the perforating gun. In operation, a detonation wave propagates within the detonating cord on its way toward the perforating gun. However, before the detonation wave reaches the perforating gun, the detonation wave propagates through the frangible breakup element. In response to the passage of the detonation wave through the frangible breakup element, the frangible element shatters into a multitude of pieces. Before the frangible element shatters, the frangible element absolutely prevents any shock from being absorbed by the shock absorber of the present invention. As a result, preloading effects are avoided. However, after the frangible element shatters, the shock absorber of the present invention is ready to absorb the shock resultant from the detonation of the perforating gun. After the frangible element shatters, in response to the detonation wave passing therethrough, the inner and outer housings move in opposite directions relative to one another in response to a received shock and the crushable element begins to permanently deform. An upward or a downward shock may be absorbed by the shock absorber, but only after the frangible breakup element shatters in response to the detonation wave in a detonating cord passing therethrough.

21 Claims, 12 Drawing Sheets

FIG. 3
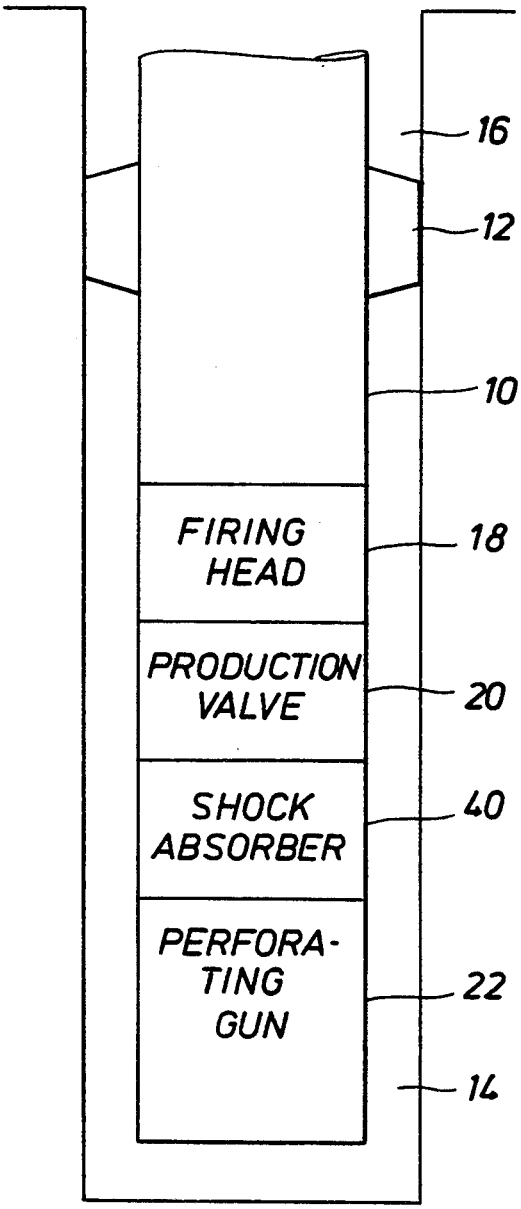
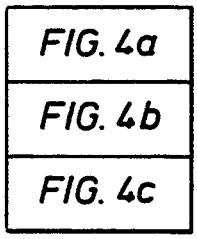
FIG. 4c
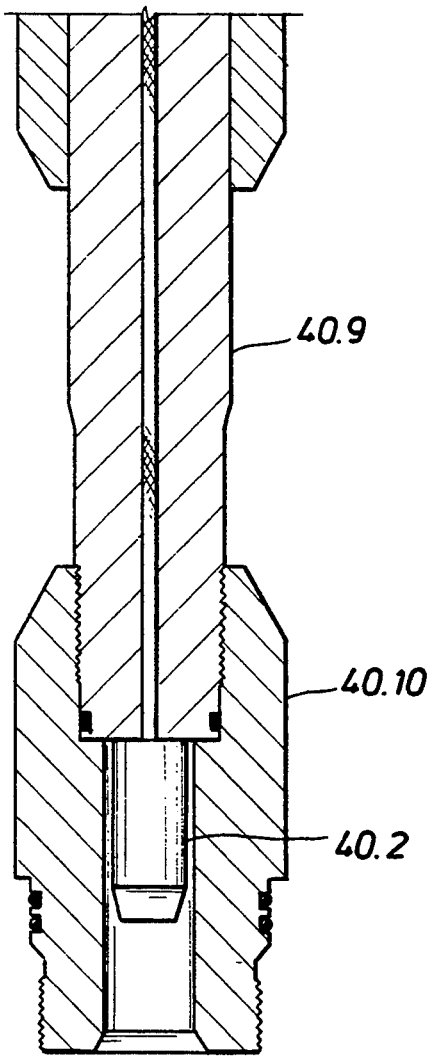
FIG. 4d
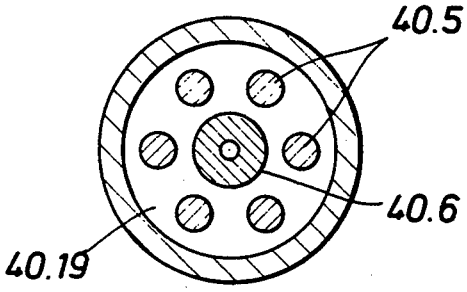

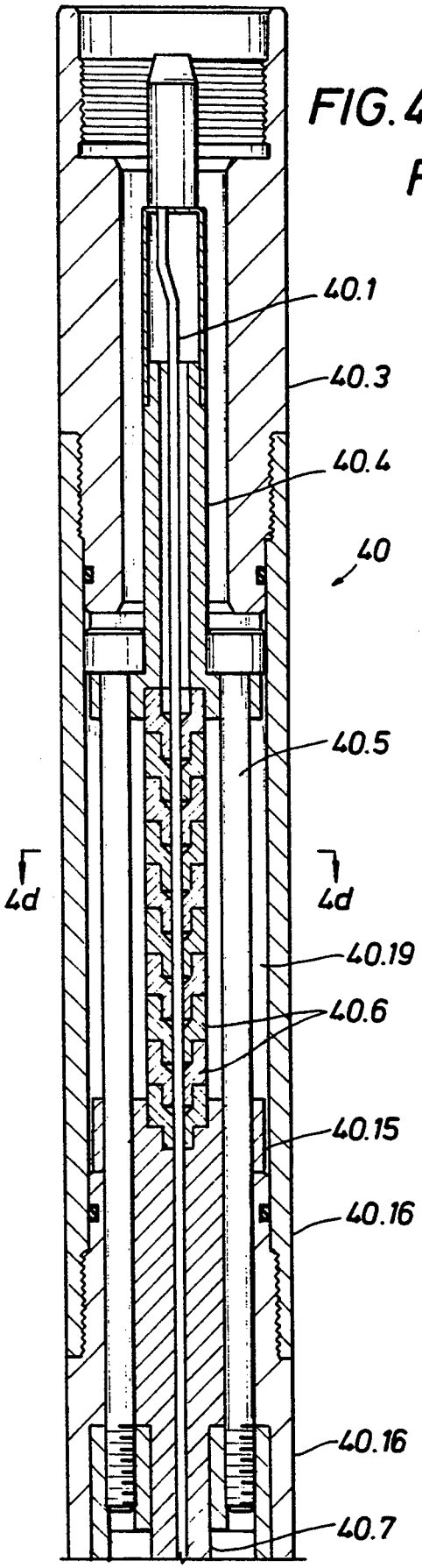
FIG. 4a
FIG. 4b
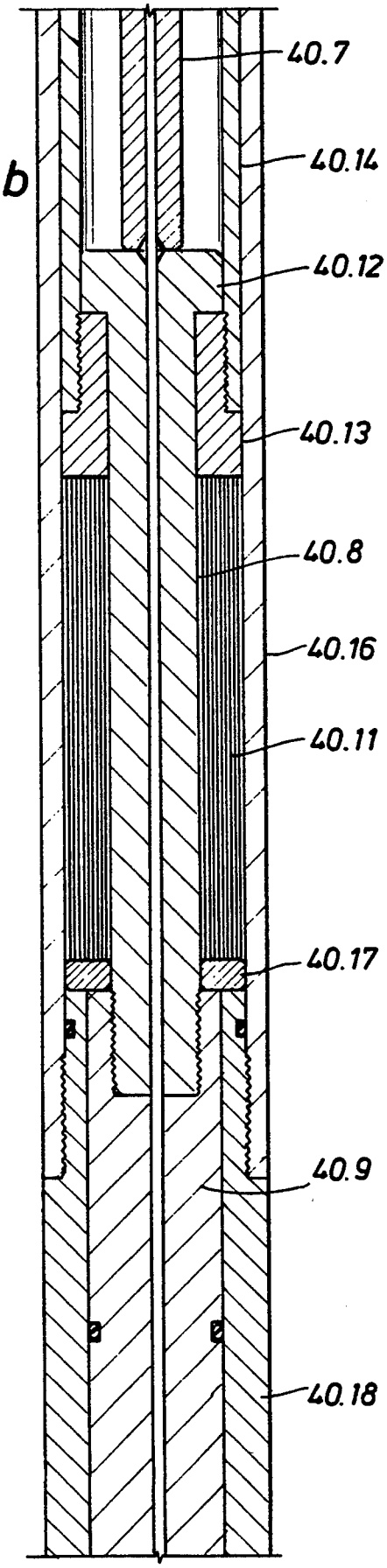

FIG. 5a
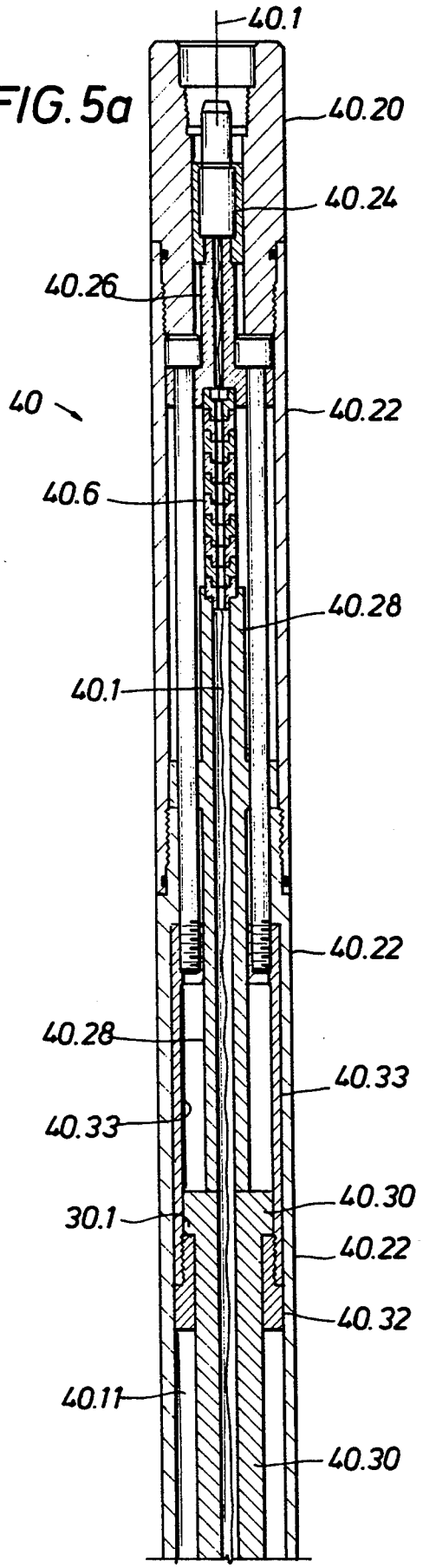
FIG. 5a
FIG. 5b
FIG. 5b
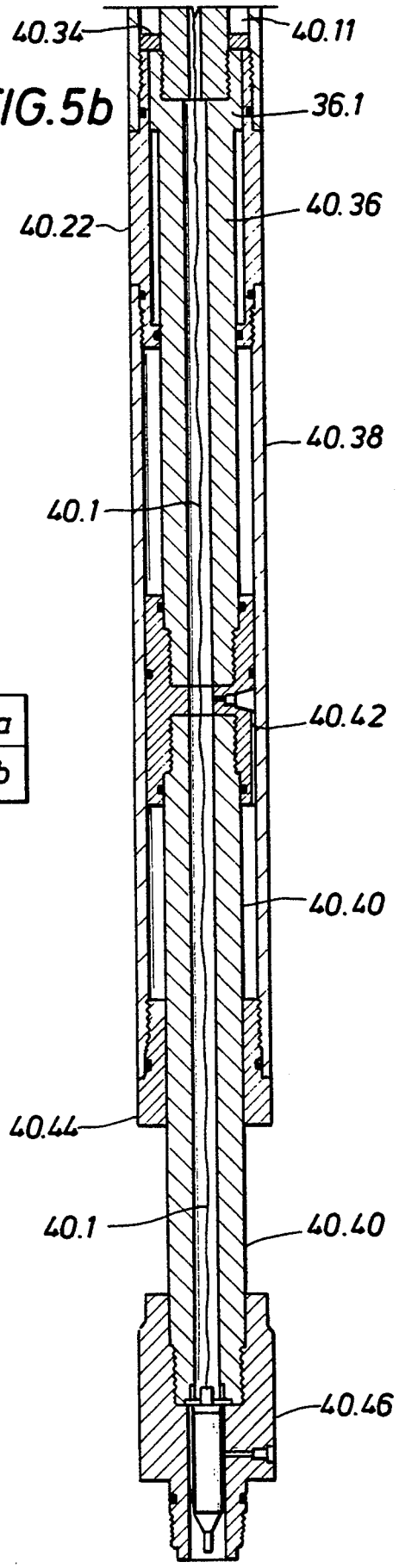

| |
|---|
| FIG. 6a1 |
| FIG. 6a2 |
| FIG. 6a3 |
FIG. 7
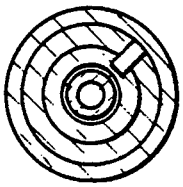
FIG. 6a1
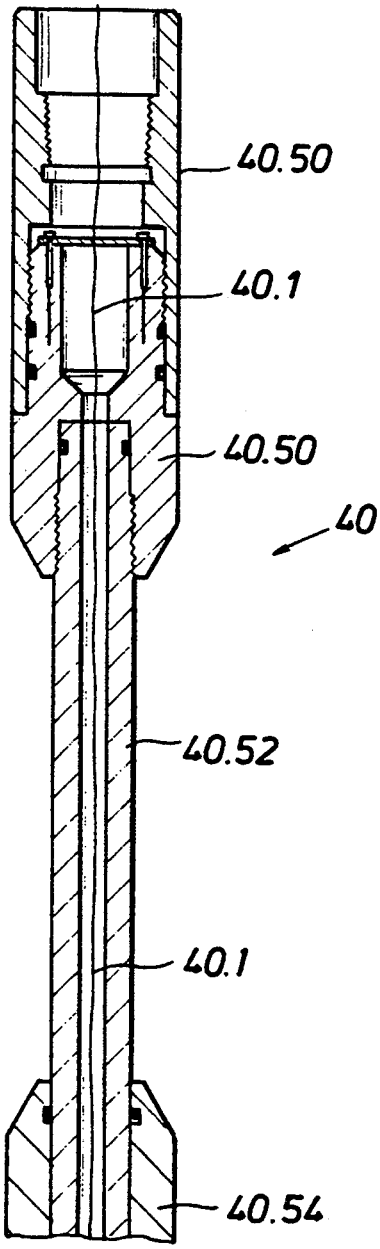
FIG. 8
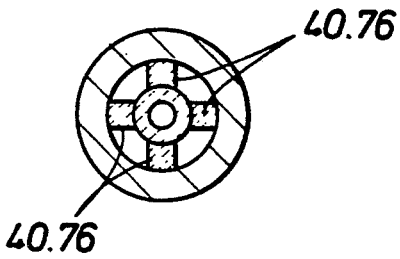

FIG.6a2
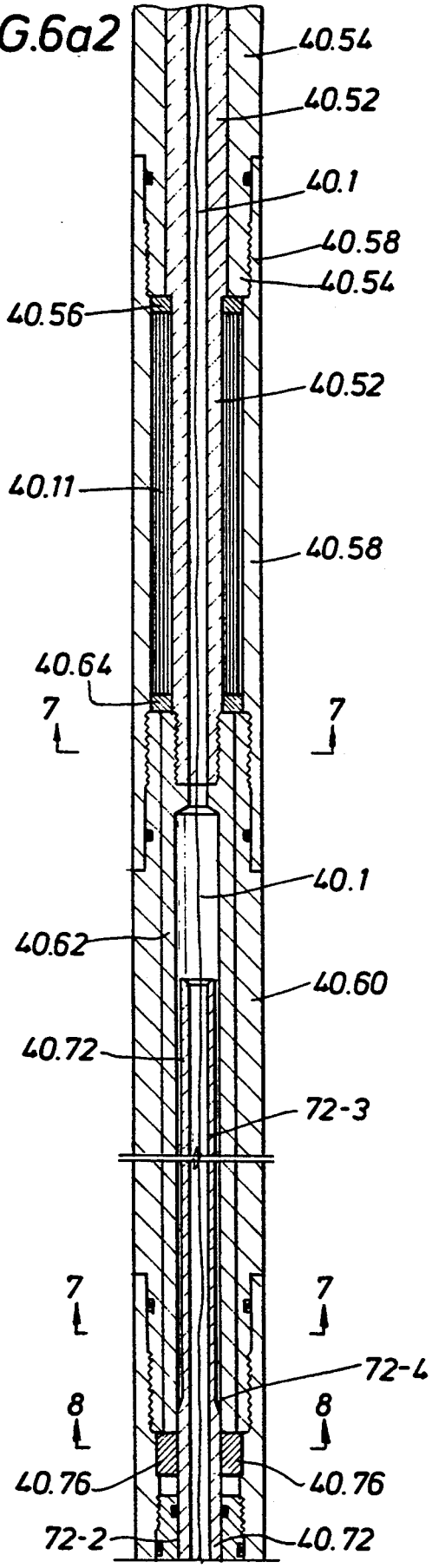
FIG.6a3
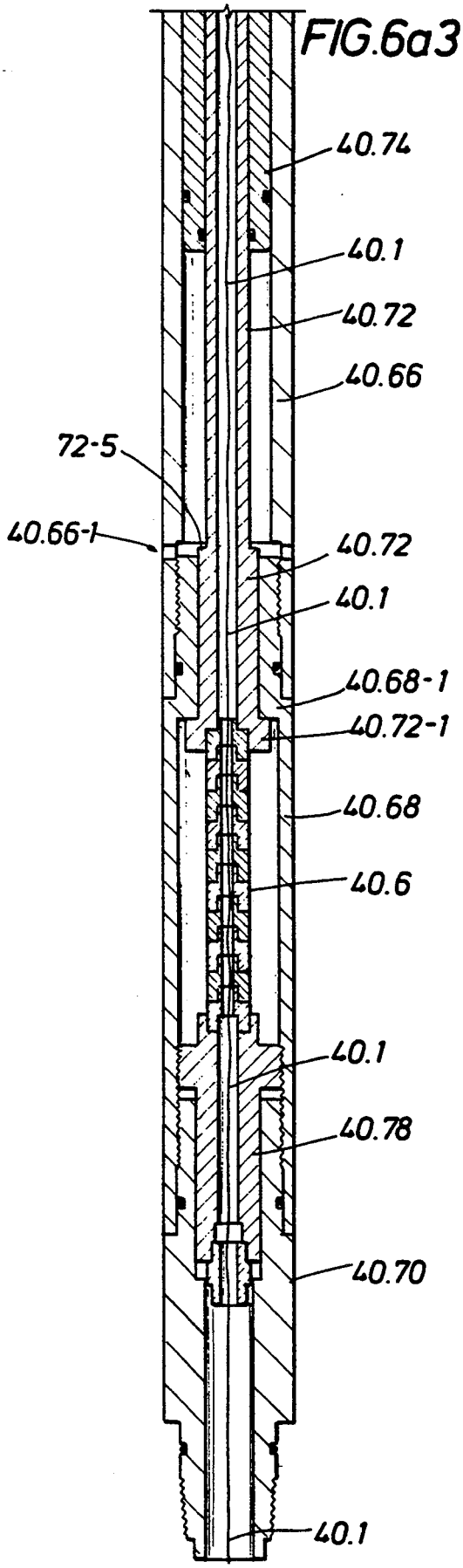

| |
|---|
| FIG. 6b1 |
| FIG. 6b2 |
| FIG. 6b3 |
FIG.6b1
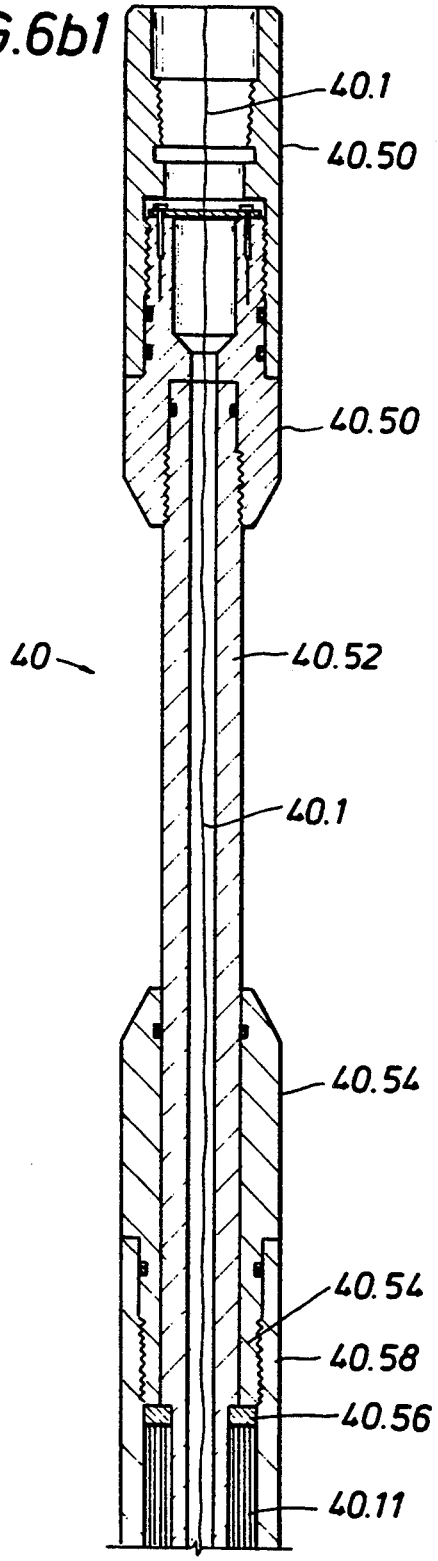
| |
|---|
| FIG.6c1 |
| FIG.6c2 |
| FIG.6c3 |
FIG.6c1
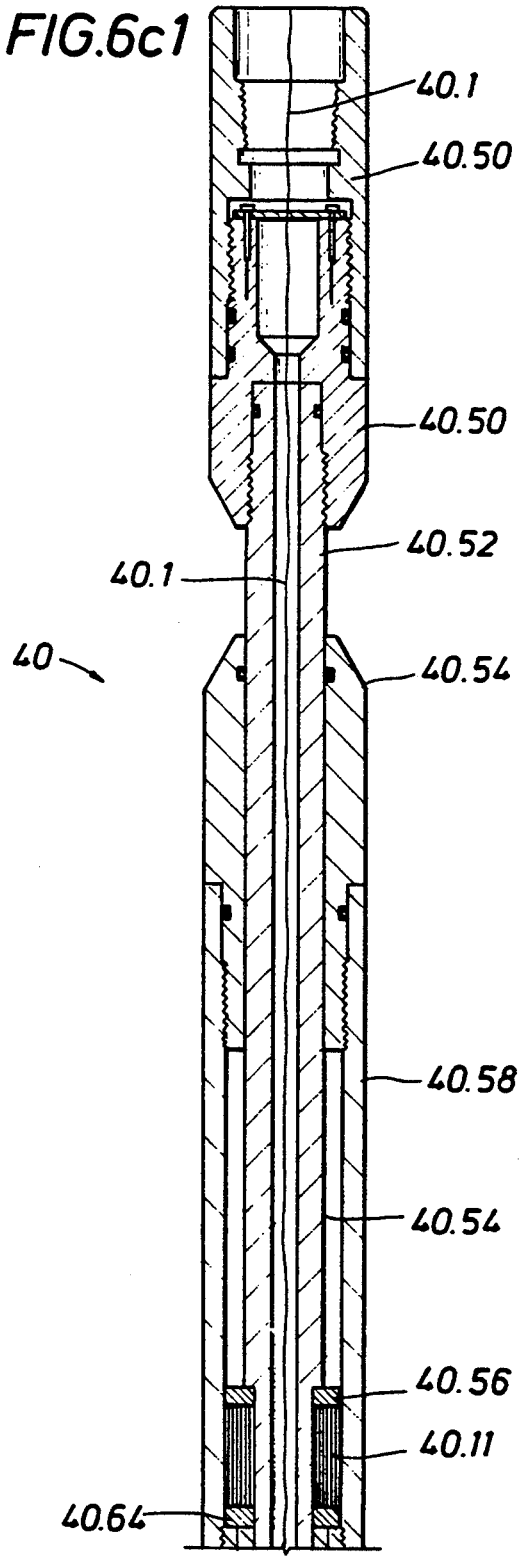

FIG.6b2
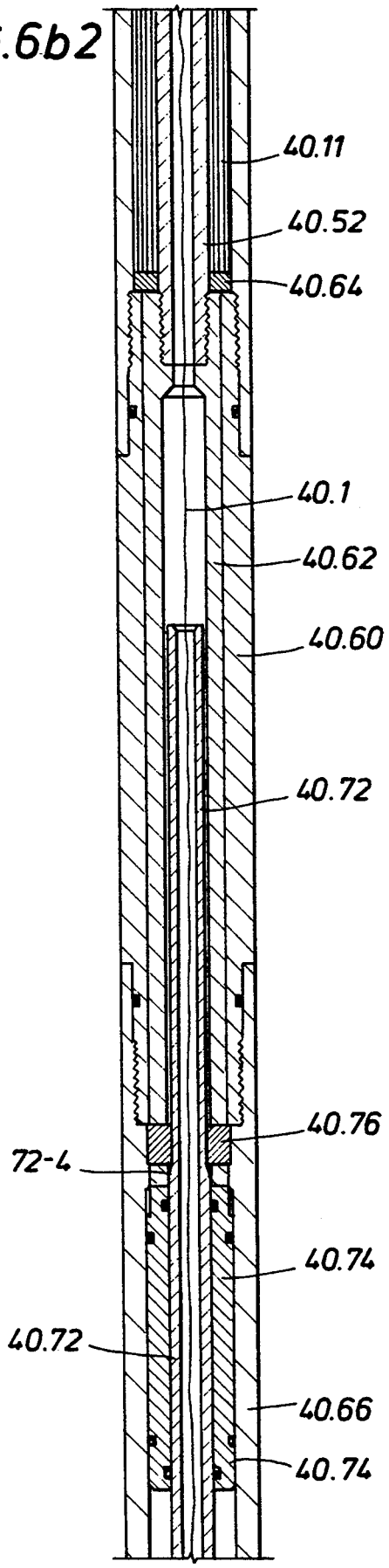
FIG.6c2
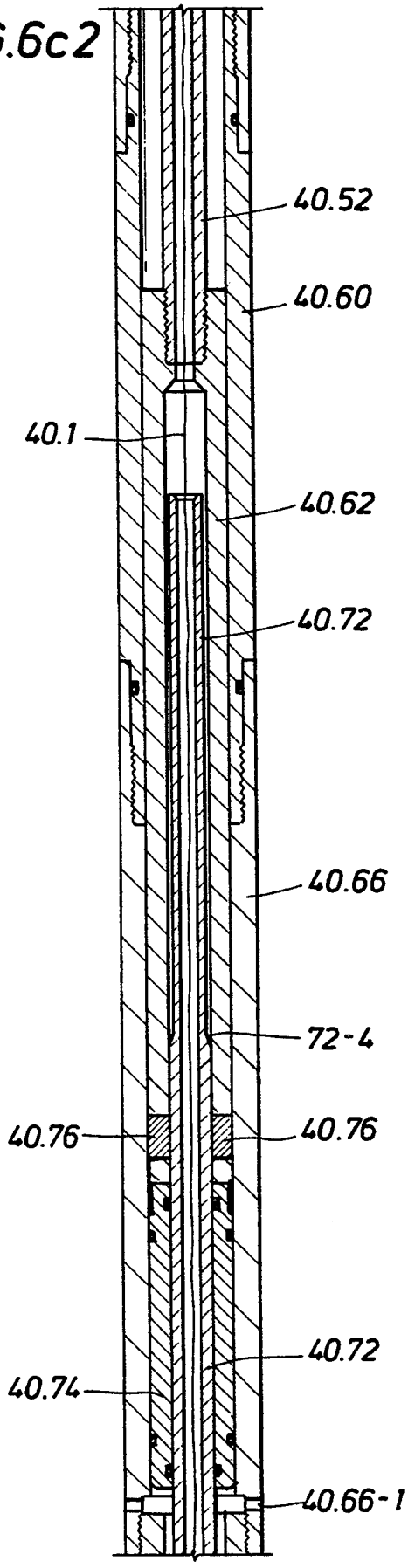

FIG. 6b3
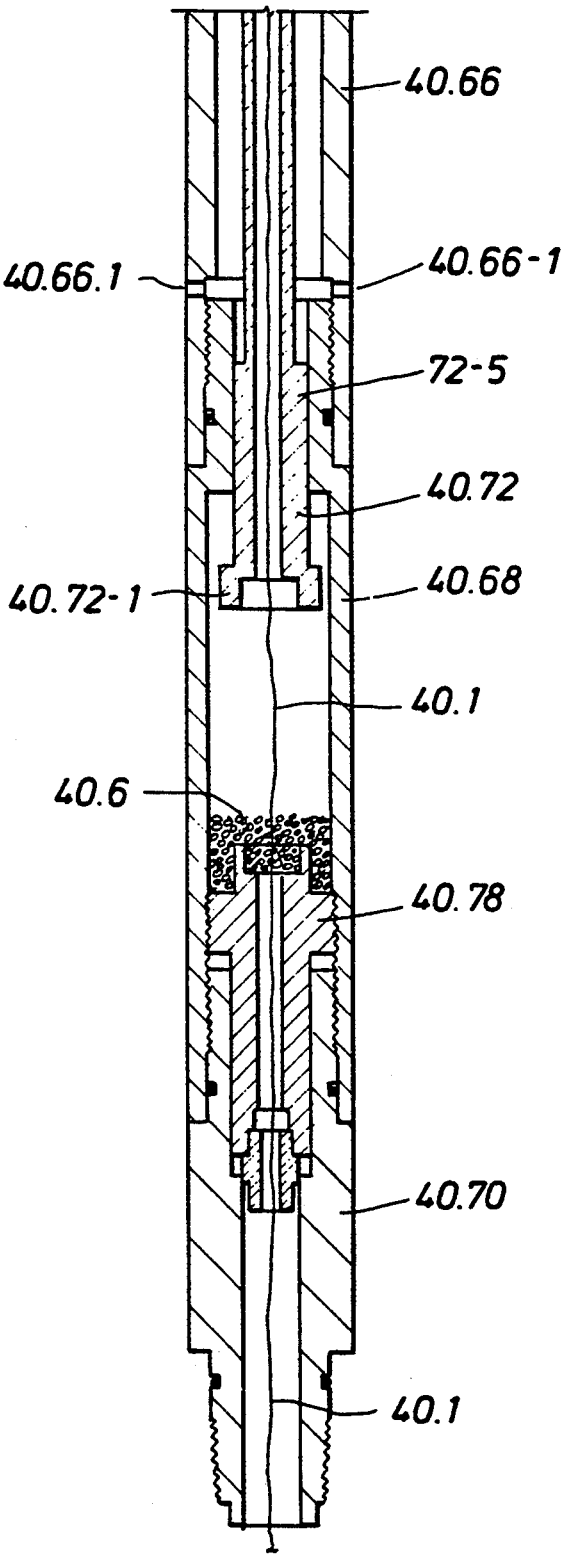
FIG. 6c3
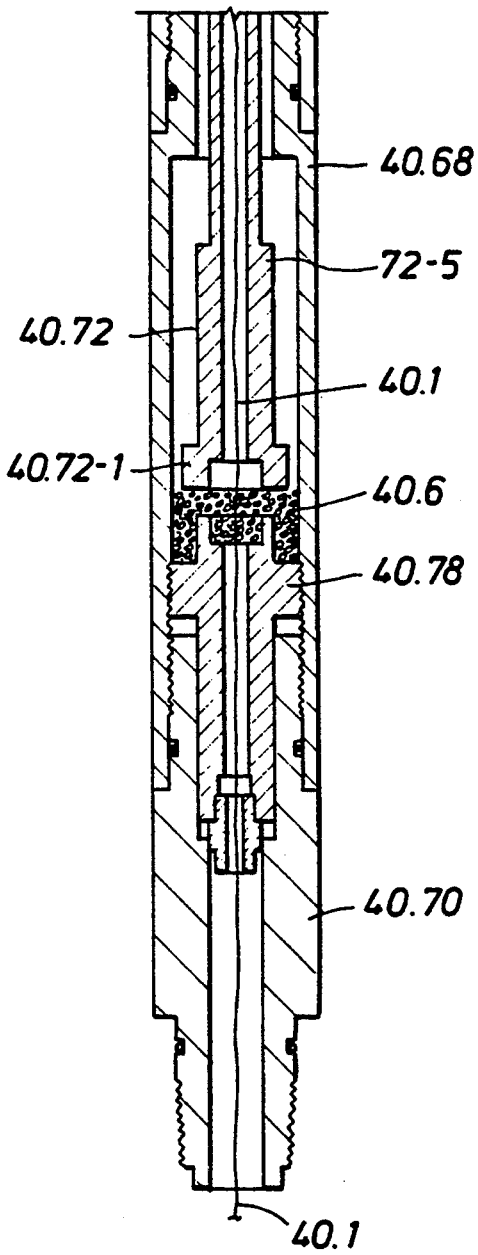

| |
|---|
| FIG.6d1 |
| FIG.6d2 |
| FIG.6d3 |
FIG.6d1
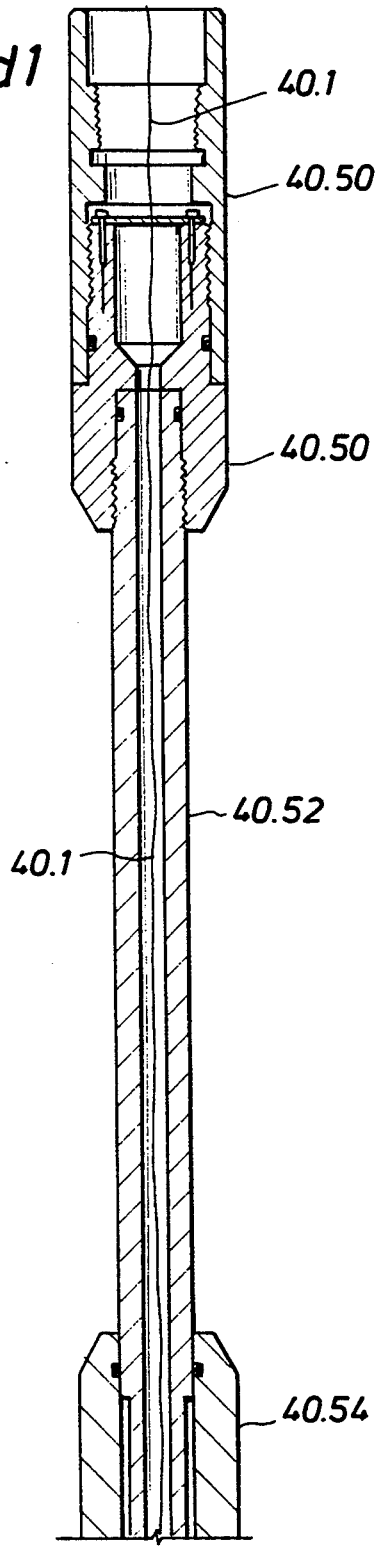
FIG.6d2
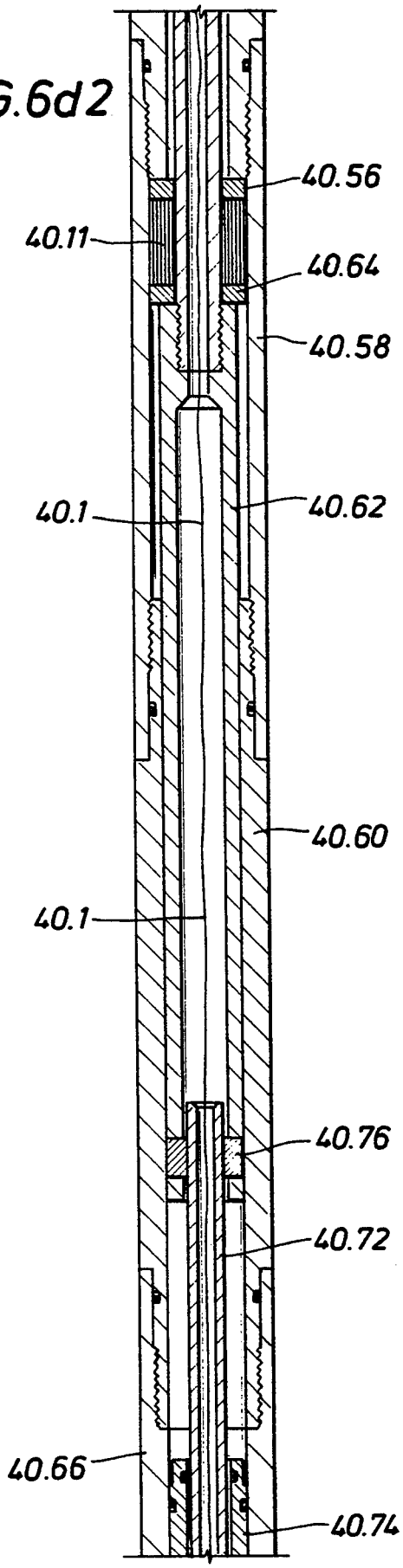

FIG.6d3
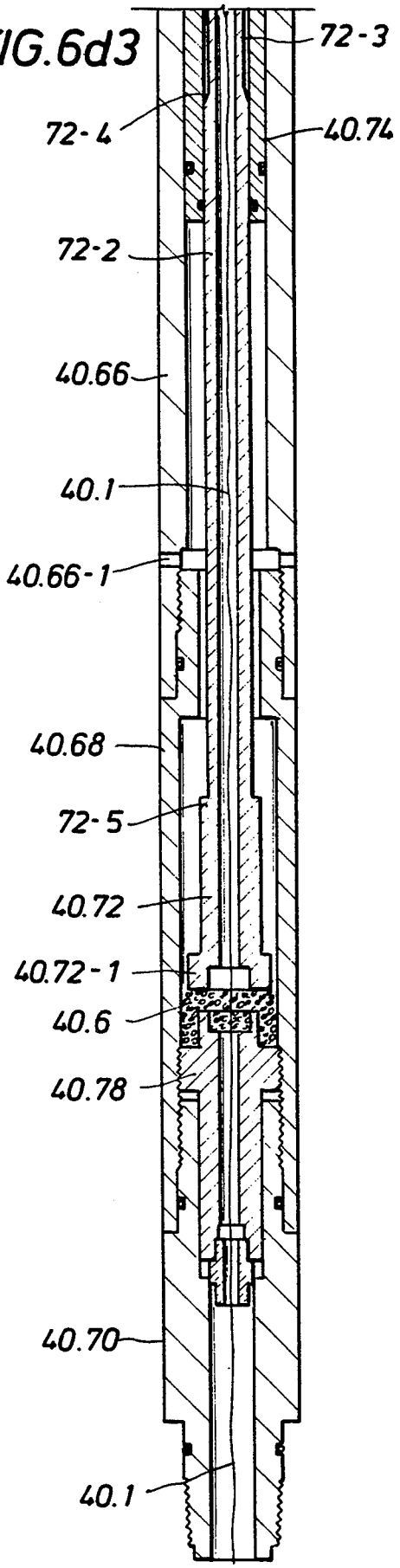
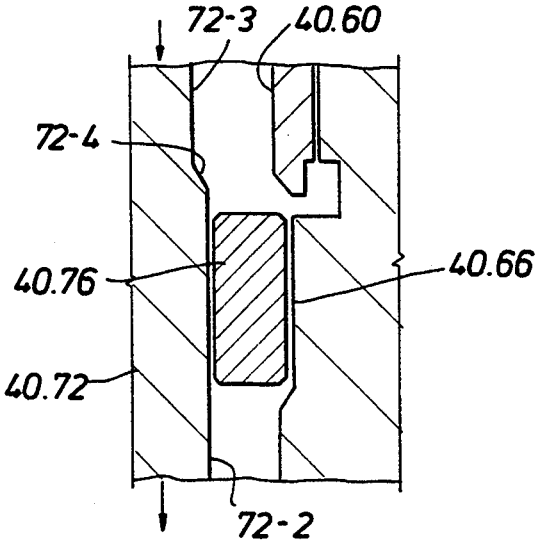
FIG.9
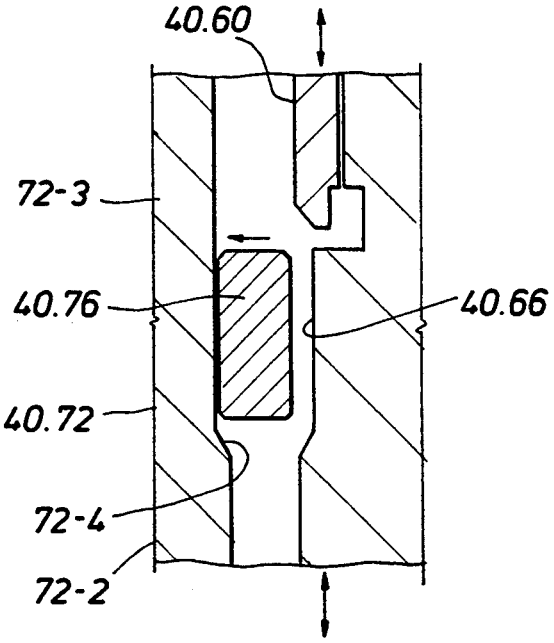
FIG.10

SHOCK ABSORBER FOR USE IN A WELLBORE INCLUDING A FRANGIBLE BREAKUP ELEMENT PREVENTING SHOCK ABSORPTION BEFORE SHATTERING ALLOWING SHOCK ABSORPTION AFTER SHATTERING

CROSS REFERENCE TO RELATED APPLICATIONS

This application is a continuation-in-part of application Ser. No. 07/955,816 filed Oct. 2, 1992, now U.S. Pat. No. 5,318,126, which is a continuation in part of application Ser. No. 07/858,400 filed Mar. 26, 1992, now abandoned, which becomes FWC Ser. No. 08/032,817 filed May 16, 1993, now U.S. Pat. No. 4,293,940.

BACKGROUND OF THE INVENTION

The subject matter of the present invention relates to shock absorbers adapted for use in a wellbore, and more particularly, to a shock absorber adapted to be connected between a production valve and a perforating gun of a tool string disposed in a wellbore for absorbing shock resulting from detonation of the perforating gun, the shock absorber including a frangible breakup element which shatters in response to a detonation wave passing therethrough, the shock absorber absorbing the shock from the detonation of the perforating gun only when the frangible breakup element shatters.

While many types of shock absorbers have been used downhole in a wellbore, all have similar problems. Most shock absorbers use dual elements, an upward element for absorbing an upward shock and a downward element for absorbing a downward shock. The downward element is often preloaded by the weight of the tool string below the element, and the upward element is often preloaded when the tool string encounters a bridge or tight spot when being lowered into the borehole. Some shock absorbers, such as U.S. Pat. Nos. 4,693,317 and 4,817,710 to Edwards et al, attempted to reduce or eliminate this preloading effect by preloading both the upward and downward elements; this would assist in preventing a shock from having a running start or rebounding at the absorbing elements. This shock absorber was not sealed thereby limiting its use to certain wells where it could be run above the gun string and below a packer. Preloading of the elements also caused the shock absorber to vary in length when made up in a string, due to the different weights of equipment run below the shock absorber on the tool string. This variation in length made it difficult to determine the precise location of the perforating guns in the wellbore. Furthermore, current shock absorbers cannot be run within an explosive train of the tool string since most are not sealed. In addition, most current shock absorbers use two shock elements which are usable for a single job, making it expensive to repair and maintain. However, one shock absorber, which is not subject to aforementioned preloading effects when being raised or lowered in a borehole, is disclosed in U.S. Pat. No. 5,131,470 to Miszewski et al. The Miszewski shock absorber has two energy absorbing elements, one for upward shock and one for downward shock, and the shock absorber can be run within an explosive train of the tool string. The shock absorber is not subject to preloading due primarily to a physical connection which exists between an inner and outer housing, the two shock absorbing elements being disposed between the two housings. The physical connection is broken in response to a detonation wave in a detonating cord, the detonation wave detonating a donut shaped breakup charge, a jet from the breakup charge breaking the physical connection. Such breakup charges are not very reliable. Thus, another method and apparatus is needed to avoid the aforementioned preloading effects which exist when the shock absorber is raised and lowered in a wellbore, yet to selectively allow the shock absorber to absorb a shock which results when a perforating gun is detonated in a wellbore.

SUMMARY OF THE INVENTION

Accordingly, it is a primary object of the present invention to provide a shock absorber, adapted to be disposed in a wellbore and located above a perforating gun in a wellbore apparatus, which cannot be subject to preloading effects and cannot absorb a shock prior to detonation of the perforating gun when the wellbore apparatus is being raised from or lowered into the wellbore but which will shatter a frangible breakup element and detonate the perforating gun in response to a detonation wave propagating in a detonating cord and will absorb the shock resultant from the detonation of the perforating gun after the frangible element shatters.

It is a further object of the present invention to provide a shock absorber, adapted to be disposed above a perforating gun of a wellbore apparatus in a wellbore, which will shatter a frangible breakup element and detonate the perforating gun in response to a detonation wave propagating in a detonating cord, will allow a lower break plug support and an element mandrel to move upwardly after the frangible breakup element shatters in response to a shock resultant from detonation of the perforating gun, will allow a crushable shock absorbing element to permanently deform in response to the upward movement of the break plug support and element mandrel, and will therefore absorb the shock resultant from the detonation of the perforating gun.

These and other objects of the present invention are accomplished by a shock absorber adapted to be disposed above a perforating gun in a tool string and adapted to be disposed in a wellbore. The shock absorber includes a crushable element disposed between an inner and outer housing, a frangible breakup element, and a detonating cord disposed within the frangible breakup element and connected to the perforating gun. In operation, a detonation wave propagates within the detonating cord on its way toward the perforating gun. When the detonation wave reaches the perforating gun, the gun detonates and a backward kick or shock results. This shock must be absorbed. However, before the detonation wave reaches the perforating gun, the detonation wave propagates through the frangible breakup element. As a result, in response to the passage of the detonation wave through the frangible breakup element, the frangible element shatters into a multitude of pieces. Before the frangible element shatters, the frangible element absolutely prevents any shock from being absorbed by the shock absorber of the present invention. As a result, preloading effects are avoided. However, after the frangible element shatters, the shock absorber of the present invention is ready to absorb the shock resultant from the detonation of the perforating gun. Consequently, after the frangible element shatters, in response to the shock resultant from the perforating gun detonation, the inner and outer housings move in opposite directions relative to one another and the crushable element begins to permanently deform. Since one housing may move in either direction (upward or downward) relative to the other housing, an upward or a downward shock may be absorbed by the shock absorber, but only after the frangible breakup element shatters in response to the detonation wave propagating therein within the detonating cord.

As a result, the shock absorber of the present invention is an explosively activated, rigid member shock absorber with a dual acting, single element, a new concept in absorbing shock. Since an explosive train has not yet been initiated, the shock absorber is rigid when being run into a borehole. This makes precise location of the perforating guns of the tool string easy to determine, from job to job, and the design prevents forces from being applied to the shock absorbing element while being run into the borehole. The subject shock absorber is sealed thereby allowing it to be run within the tool string (i.e., between a firing head and a perforating gun), providing protection to the other equipment in the tool string. In addition, a single shock absorbing element functions to absorb either an upward shock or a downward shock.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 3 illustrates a shock absorber connected between a production valve and a perforating gun in a wellbore;

FIGS. 4*a*–4*d* illustrate a first embodiment of the shock absorber of FIG. 3 in accordance with the present invention;

FIGS. 5*a*–5*b* illustrate a second embodiment of the shock absorber of FIG. 3 in accordance with the present invention;

FIGS. 6*a*1, 6*a*2, and 6*a*3 illlustrate a third embodiment of the shock absorber of FIG. 3 in accordance with the present invention;

FIGS. 6*b*1–6*d*3 illustrate a functional operation of the third embodiment of the shock absorber of FIGS. 6*a*1–6*a*3;

FIG. 7 illustrates a cross-section of the third embodiment of the shock absorber of the present invention taken along section lines 7—7 of FIG. 6*a*2;

FIG. 8 illustrates a cross section of the third embodiment of the shock absorber of the present invention taken along section lines 8—8 of FIG. 6*a*2; and FIGS. 9 and 10 are enlarged partial sectional views of a portion of the third embodiment of the shock absorber illustrating the locking dogs which are shown in FIGS. 6*a*2, 6*b*2, 6*c*2, 6*d*2 and 8 of the drawings.

DETAILED DESCRIPTION OF THE PREFERRED EMBODIMENT

Figure 1:
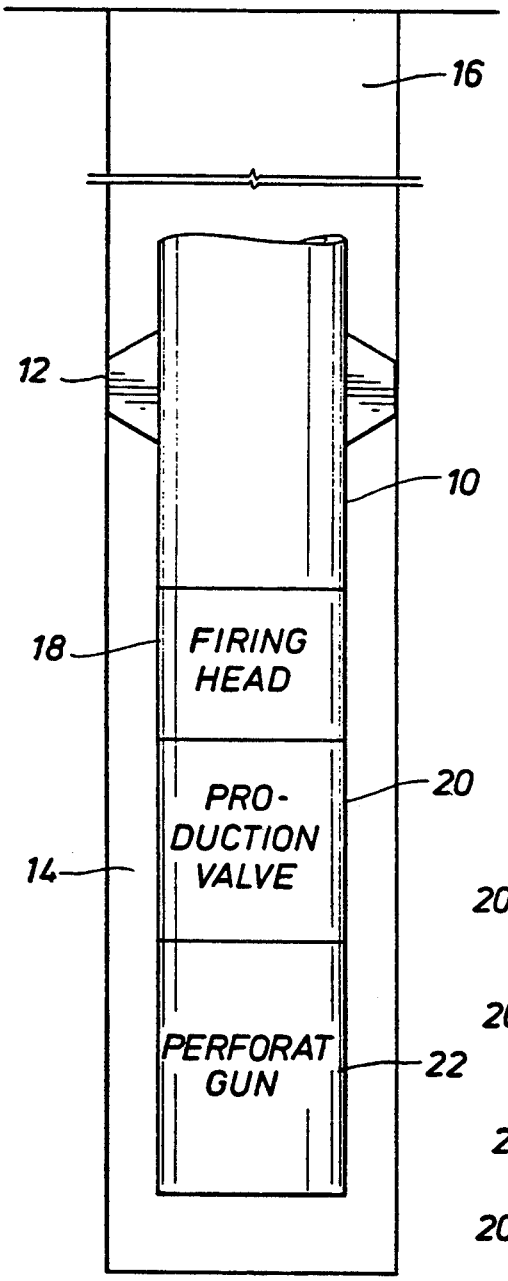
FIG. 1 illustrates a production valve connected between a firing head and a perforating gun in a wellbore.

The Detailed Description will be divided into two parts:

Part A consisting of the specification of the prior pending application serial number 07/955,816, filed 10/02/92, to Edwards et al, entitled "Explosively Opened Production Valve including a Frangible Breakup Element operated by Tubing Pressure or Rathole Pressure of Both"; and Part B consisting of the specification of this application which discloses "a Shock Absorber for use in a Wellbore including a Frangible Breakup Element Preventing Shock Absorption before Shattering and Allowing Shock Absorption after Shattering" in accordance with the present invention.

A. Explosively Opened Production Valve Including a Frangible Breakup Element Operated by Tubing Pressure or Rathole Pressure or Both Referring to FIG. 1, a tubing string 10 is disposed in a wellbore. A packer 12 isolates a rathole annulus 14 from an above packer annulus 16. A firing head 18 is connected to tubing 10, a production valve 20 is connected to the firing head 18, and a perforating gun 22 is connected to the production valve 20. In operation, when the firing head 18 detonates, a detonation wave begins to propagate within a detonating cord connected to the firing head. The detonating cord passes through the production valve 20 and the perforating gun 22. When the detonation wave passes through the production valve 20, the valve 20 opens thereby communicating the rathole annulus 14 to the internal portion of the tubing 10 and creating an underbalanced condition within the rathole annulus 14. When the detonating wave reaches the perforating gun 22, the perforating gun 22 detonates thereby perforating a formation traversed by the wellbore. Well fluid produced from the formation enters the rathole annulus 14 and then enters the opened production valve 20. The well fluid then enters the internal portion of tubing 10 and propagates uphole to the wellbore surface.

Figure 2A:
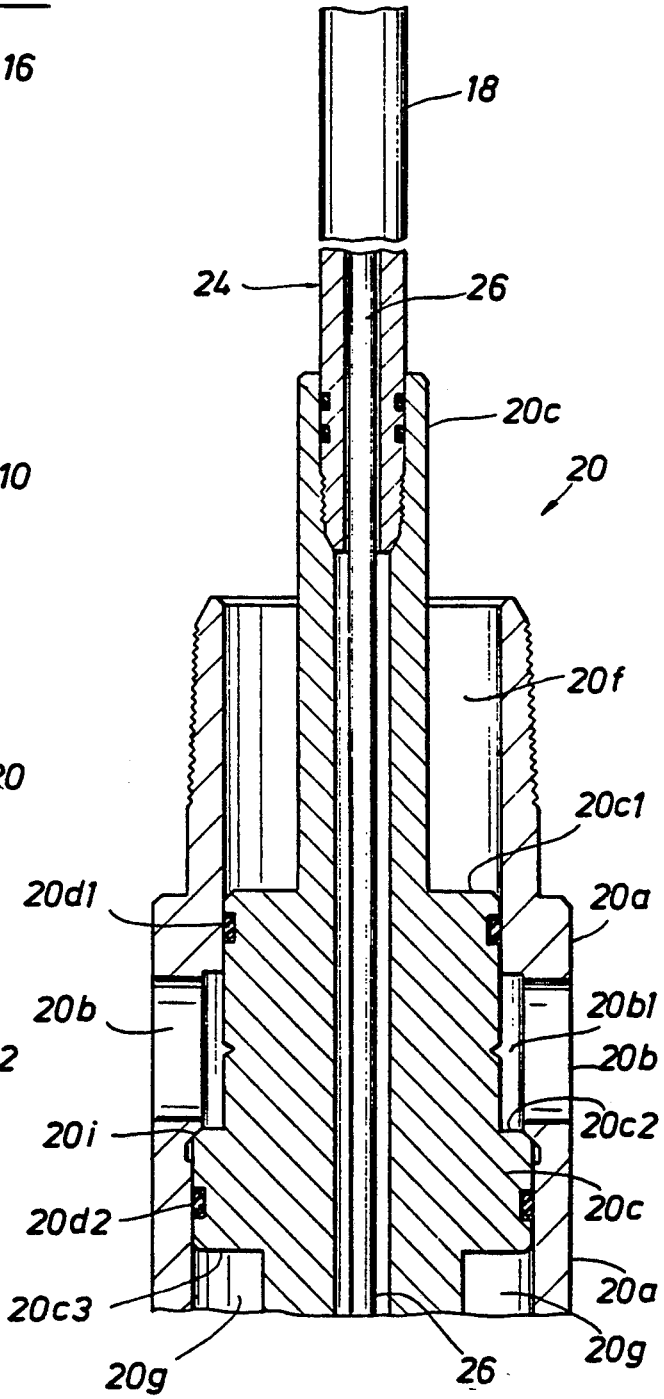
FIGS. 2*a*–2*c* illustrate a detailed construction of the production valve of FIG. 1.
Figure 2B:
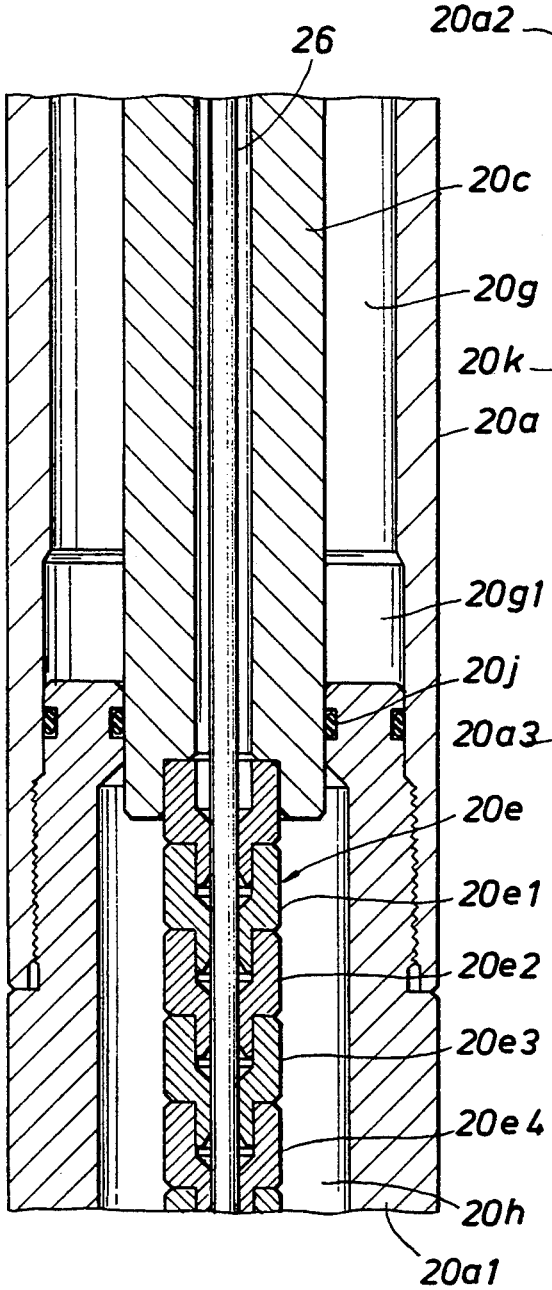
Figure 2C:
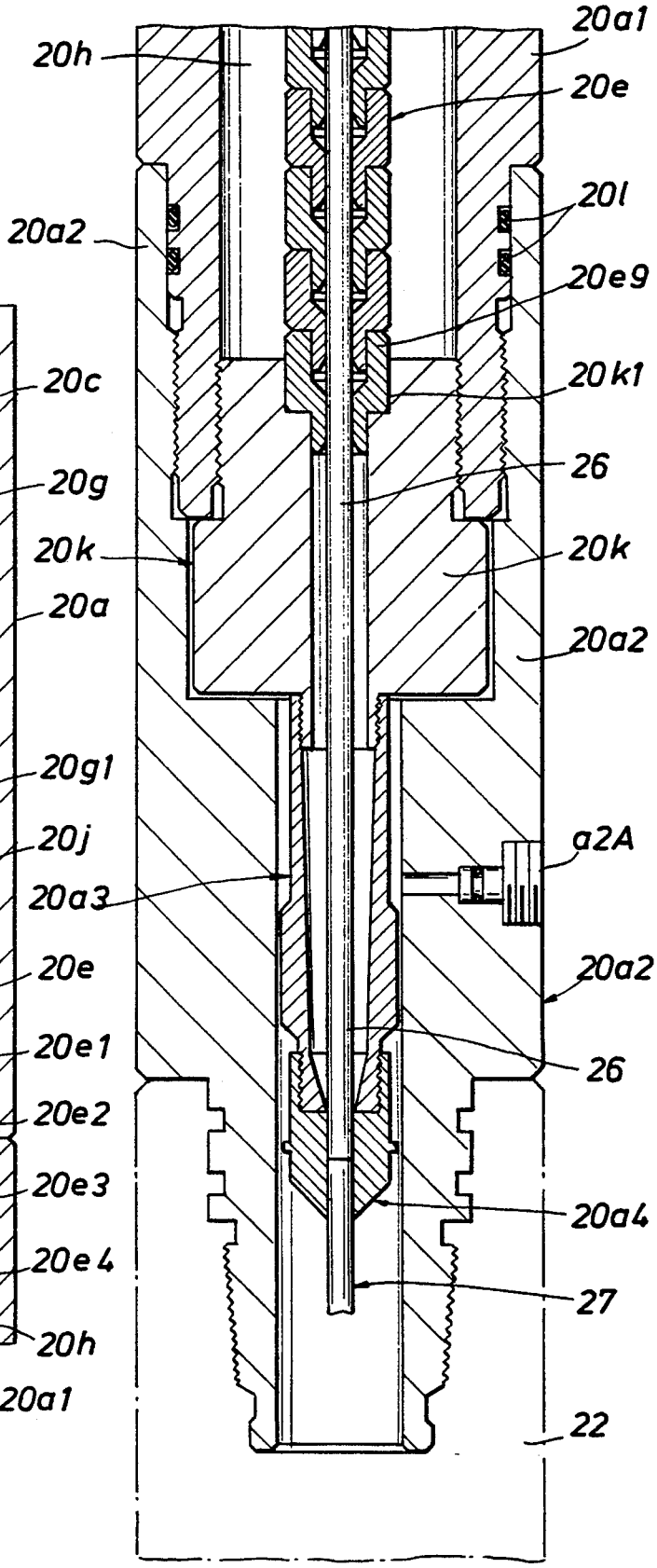

Referring to FIGS. 2*a*–2*c*, a detailed construction of the production valve 20 of FIG. 1, in accordance with the present invention, is illustrated.

In FIG. 2*a*, the production valve 20 includes a housing 20*a* and production ports 20*b* disposed through a wall of the housing 20*a*, the ports 20*b* having a port cavity 20*b*1. A piston 20*c* is disposed within the housing 20*a*. A detonating cord tube 24 is sealingly connected to one end of the piston 20*c*, the detonating cord tube receiving a detonating cord 26. The piston 20*c* includes a bore in which the detonating cord 26 is disposed, the detonating cord from the detonating cord tube 24 passing through the piston 20*c* of the valve 20 and ultimately being connected to the shaped charges disposed within the perforating gun 22. The piston 20*c* is supported, on its other end, by a frangible breakup element 20*e* (FIG. 2*b*), in accordance with the present invention, which prevents the piston 20*c* from moving downwardly within the housing 20*a*. A shoulder 20*i* prevents the piston 20*c* from moving upwardly within the housing 20*a*. If the piston 20*c* were not supported by the frangible breakup element 20e, the piston 20c would be movable downwardly within the housing 20c from one position, where the ports 20b are closed as shown in FIG. 2a, to another position, where the ports 20b are open. A first pair of o-rings 20d1 and 20d2 seal the piston 20c to the housing 20a and close off the production ports 20b when the piston 20c is disposed in the one position shown in FIG. 2a. When the piston 20c is disposed in the one position, as shown in FIG. 2a, one o-ring 20d1is disposed on one side of the port 20b, the other o-ring 20d2 being disposed on the other side of the port 20b. As a result, when the production ports 20b are sealed off as shown in FIG. 2a, the production ports 20b are closed, the rathole annulus 14 is not in an underbalanced condition, and the rathole annulus 14 cannot fluidly communicate with the internal portion of the tubing 10.

A first space 20f, disposed between the piston 20c and the housing 20a, is defined by an internal surface of housing 20a, an external surface of piston 20c, and a first working surface 20c1 of the piston 20c. The first working surface 20c1 of piston 20c is subject to the pressure of fluids disposed within the tubing 10 (tubing pressure). The piston 20c includes a second working surface 20c 2, disposed within the cavity 20b1 of the production ports 20b, which is subject to the pressure of fluids disposed within the rathole annulus 14 (rathole pressure). An air chamber 20g is defined by another internal surface of the housing 20a, another external surface of piston 20c, and a third surface 20c 3 of the piston 20c. The air chamber 20g is provided to assist the tubing and rathole pressures in overcoming any pressure built up in a breakup chamber 20h (FIG. 2b).

In FIG. 2b, the housing 20a is threadedly and sealingly connected to a second housing 20a1, the housing 20a enclosing the air chamber 20g and an enlarged portion 20g1 of the air chamber 20g, the second housing 20a1 enclosing the breakup chamber 20h. The second housing 20a1 is also sealingly connected, via an o-ring 20j, to piston 20c. The housing 20a and second housing 20a1 also enclose the piston 20c and the frangible breakup element 20e in accordance with the present invention. The frangible breakup element 20e is actually comprised of a plurality of individual breakup elements 20e1, 20e2, . . . , 20e4, . . . , 20e10 connected together in serial fashion, where each individual breakup element is comprised of the following material: gray-iron class 40 (spec number ASTM A48-76), otherwise more commonly known as grade 40 cast iron. The detonating cord 26, adapted for propagating a detonation wave, passes through the center of the piston 20c and frangible breakup element 20e. The material of the frangible breakup element 20e is specifically designed to shatter into a multitude of pieces when the detonation wave, propagating within the detonating cord 26, passes through the frangible breakup element 20e, The remaining parts of the production valve 20, such as the housings and the piston, are comprised of alloy steel. As shown in FIG. 2b, as long as the frangible breakup element 20e is intact, it provides support for the piston 20c, preventing the piston 20c from moving downwardly in FIG. 2b. However, when the breakup elements 20e shatter in response to a detonation wave propagating within the detonating cord 26 disposed within the breakup element 20e, the support for the piston 20c is removed and the piston 20c is free to move downwardly in FIG. 2b in response to either tubing pressure or rathole pressure or both.

In FIG. 2c, the second housing 20a1 is sealingly connected via o-rings 20L and threadedly connected to a third housing 20a2, the second housing 20a1 being further threadedly connected to a breakup adaptor 20k. The breakup adaptor 20k includes a recess 20k1 for holding and supporting the frangible breakup elements 20e. The detonating cord 26 passes through the center of the frangible breakup elements 20e and the breakup adaptor 20k. The third housing 20a2 includes a bleed valve a2A for allowing safe disassembly of the tool should debris from either the breakup element 20e or other parts of the perforating gun 22 prevent dispersal of the pressures of detonation prior to exiting the wellbore following completion of the perforating job. The third housing 20a2 encloses a first sub-housing 20a3 and a second sub-housing 20a4, which sub-housings further enclose the detonating cord 26 which passes through the center of the production valve 20, and position a donor booster 27 to initiate the perforating gun 22.

A functional description of the operation of the production valve 20, and particularly the frangible breakup elements 20e of the production valve 20, in accordance with the present invention, is set forth in the following paragraphs with reference to FIGS. 1 and 2a–2c of the drawings.

In FIGS. 2a–2c, when the firing head 18 (such as a trigger charge firing head or a hydraulic time delay firing head) detonates, the detonation will initiate the propagation of a detonation wave within the detonating cord 26. The detonation wave will propagate down the detonating cord 26, through the center of the detonating cord tube 20c, through the center of piston 20c, through the center of the frangible breakup elements 20e, through the center of breakup adaptor 20k, through the center of sub-housings 20a3 and 20a4, and toward the shaped charges disposed within the perforating gun 22. Initially, the piston 20c is disposed in its one position, supported in this position by the frangible breakup elements 20e, which position is shown in FIG. 2a of the drawings. In this position, the production ports 20b are closed and the o-rings 20d1 and 20d2 effectively seal off any fluid communication which may exist between the rathole annulus 14 the internal portion of tubing 10. However, in accordance with the present invention, when the detonation wave propagating within detonating cord 26 passes through the center of the frangible breakup elements 20e, due to the material (cast iron) of which the breakup elements 20e are made, all of the individual breakup elements 20e will shatter into a multitude of pieces. When the breakup elements 20e shatter, the debris from the breakup elements 20e will fall into the breakup chamber 20h. At this point, the piston 20c is no longer supported by the breakup elements. Although the shoulder 20i prevents the piston 20c from moving upwardly, since the breakup elements 20e have already shattered, there is nothing to prevent the piston 20c from moving downwardly in FIGS. 2a–2c. Recall that tubing pressure is acting on the first working surface 20c1 in FIG. 2a, and that rathole pressure is acting on the second working surface 20c2 in FIG. 2a. Therefore, the piston 20c will now move downwardly in response to either the tubing pressure or the rathole pressure acting on either one or both of working surfaces 20c1 and/or 20c2. When the piston 20c moves downwardly by a predetermined distance, o-ring 20d1 of piston 20c passes by the shoulder 20i of housing 20a thereby opening a fluid communication path between rathole annulus 14 and the internal portion of tubing 10. An underbalanced condition is now achieved in rathole annulus 14. As a result, when the detonation wave in detonating cord 26 reaches the shaped charges in the perforating gun 22, the gun 22 detonates. Since an underbalanced condition exists in the rathole annulus 14, the well fluid produced from the formation will flow into production ports 20*b* of the production valve 20 and uphole to the wellbore surface.

B. A Shock Absorber for Use in a Wellbore Including a Frangible Breakup Element Preventing Shock Absorption before Shattering and Allowing Shock Absorption after Shattering Referring to FIG. 3, a shock absorber 40, in accordance with the present invention, is connected between the production valve 20 and a perforating gun 22 of a tool string disposed in a wellbore.

In FIG. 3, a tubing string 10 is disposed in a wellbore. A packer 12 isolates a rathole annulus 14 from an above packer annulus 16. A firing head 18 is connected to tubing 10 and the production valve 20 discussed in Part A of this specification is connected to the firing head 18. A shock absorber 40, in accordance with the present invention, is connected to the production valve 20, and a perforating gun 22 is connected to the shock absorber 40.

In operation, when the firing head 18 detonates, a detonation wave begins to propagate within a detonating cord connected to the firing head. The detonating cord passes through the production valve 20, through the shock absorber, and toward the perforating gun 22. When the detonation wave passes through the production valve 20, the valve 20 opens thereby communicating the rathole annulus 14 to the internal portion of the tubing 10 and creating an underbalanced condition within the rathole annulus 14. When the detonation wave passes through the shock absorber 40, the shock absorber changes from a fixed, rigid (no shock absorption) condition to a flexible, resilient, non-rigid (shock absorption) condition. In the fixed (no shock absorption) condition, the shock absorber 40, being rigid and non-flexible, is not capable of absorbing shock and is not subject to any preloading effects. However, in the flexible (shock absorption) condition, the shock absorber 40 is flexible, resilient, and is capable of absorbing shock following detonation of the perforating gun 22. When the detonation wave reaches the perforating gun 22, the perforating gun 22 detonates thereby perforating a formation traversed by the wellbore. Since the shock absorber 40 changed to the flexible condition when the detonation wave in the detonating cord passed therethrough, the shock absorber 40 absorbs any shock resultant from detonation of the perforating gun 22. Well fluid produced from the formation enters the rathole annulus 14 and then enters the opened production valve 20. The well fluid then enters the internal portion of tubing 10 and propagates uphole to the wellbore surface.

Referring to FIGS. 4*a*–4*d*, a first embodiment of the shock absorber 40 of FIG. 3, in accordance with the present invention, is illustrated.

In FIG. 4*a*, a detonating cord 40.1 from the tool above runs through the center of the shock absorber 40 and terminates with a donor booster 40.2 at the bottom of the tool. An upper adapter 40.3 at the top connects the shock absorber 40 to the tool above. An upper break plug support 40.4 is shouldered against the lower end of the upper adapter 40.3. An outer housing 40.16 is threadedly connected to the upper adapter 40.3. The upper end of the upper break plug support 40.4 is recessed to accept the heads of six connecting bolts 40.5, while the lower side is recessed in the center to receive the top end of the sectional break plug 40.6. Each individual section of the sectional break plug 40.6 is comprised of a ductile iron, a material which easily shatters when a detonation wave propagating in the detonating cord 40.1 passes through the sectional break plug. Consequently, when a detonation wave propagating in the detonating cord 40.1 passes through the sectional break plug 40.6, each section of the break plug 40.6 shatters into a multitude of pieces. The lower end of the sectional break plug 40.6 fits in a recess in the top end of a lower break plug support 40.7. In FIG. 4*b*, the lower end of the lower break plug support 40.7 shoulders against an element mandrel 40.8. Element mandrel 40.8 is threadably attached to the top of a transfer housing 40.9. In FIG. 4*c*, the bottom of transfer housing 40.9 is threadably attached to the top of a lower adapter 40.10 which attaches the shock absorber 40 to a safety spacer (not shown) or to the perforating gun 22. In FIG. 4*b*, a crushable shock absorbing element 40.11, adapted to permanently deform when absorbing shock, is disposed between the outer housing 40.16 and the element mandrel 40.8. A crushable shock absorbing element 40.11, adapted to permanently deform when absorbing shock, was first disclosed in U.S. Pat. No. 5,131,470 to Miszewski et al, the disclosure of which is incorporated by reference into this specification.

FIG. 4*d* is a cross sectional view of the shock absorber of FIG. 4*a* taken along section lines 4*d*—4*d* of FIG. 4*a*.

A functional operation of the first embodiment of the shock absorber 40 of the present invention will be set forth in the following paragraphs with reference to FIG. 4*a*–4*c*.

In FIGS. 4*a*–4*c*, before the sectional break plug 40.6 shatters, upward movement of the gun string against the crushable shock absorbing element 40.11 is prevented and/or transmitted directly through the system to the upper adapter 40.3 as follows: when the gun string tries to move upward, the force is transmitted through the lower adapter 40.10 to the transfer housing 40.9 via the thread connection and likewise from the transfer housing 40.9 to the element mandrel 40.8. Since the lower break plug support 40.7, the sectional break plug 40.6, upper break plug support 40.4, and upper adapter 40.3 shoulder successively against each other, the shock absorber 40 acts like a rigid member, i.e., the force is transmitted directly through the tool and does not load the crushable shock absorbing element 40.11. In addition, downward loads on the crushable shock absorbing element 40.11 are prevented as follows: downward loads on the lower adapter 40.10 are transmitted directly to the transfer housing 40.9 and element mandrel 40.8 via the their threaded connections. The lower side of the enlarged diameter 40.12 on the upper end of the element mandrel 40.8 shoulders against the upper end of the mandrel retainer 40.13. Mandrel retainer 40.13 is threadably connected to the lower end of bolt housing 40.14. The upper end of bolt housing 40.14 is threadably connected to the six connecting bolts 40.5. The lower side of the heads of the connecting bolts 40.5 shoulder against the recesses on the top side of the upper break plug support 40.4. The recess on the lower side of the upper break plug support 40.4 rests on the top of the sectional break plug 40.6. The bottom of the sectional break plug 40.6 shoulders against the top of the lower break plug support 40.7. The bottom side of the enlarged diameter 40.15 of the lower break plug support 40.7 shoulders against the top end of the outer housing 40.16. From this discussion it is evident that a downward force on the lower adapter 40.10 of the shock absorber 40 is transmitted directly to the upper adapter 40.3, not loading the shock absorbing element 40.11, so long as the sectional break plug 40.6 has not been explosively shattered.

Once the explosive train of the system is initiated, a detonation wave begins to propagate through the detonating cord 40.1. Since the detonating cord 40.1 passes through the sectional break plug 40.6, and since the break plug 40.6 is made of ductile iron, when the detonation wave passes through the sectional break plug 40.6, the detonation wave will shatter the sectional break plug 40.6 thereby freeing up the shock absorber 40, allowing the shock absorber 40 to change from a rigid, no shock absorption condition to a flexible, resilient, shock absorption condition and enabling the shock absorber 40 to function as a shock absorber and absorb shocks which originate from either the upward or the downward direction, as described below. Debris from the shattered sectional break-up plug 40.6 gathers in the lower end of a circular cavity 40.19 leaving sufficient space for the movements to be described below.

Upward shocks are absorbed as follows: upward shocks are applied to the shock absorber 40 via the lower adapter 40.10 and are transmitted directly to the transfer housing 40.9. The upper end of the transfer housing is shouldered against a compression ring 40.17. The compression ring 40.17 shoulders against the lower end of the shock absorbing element 40.11. The upper end of the shock absorbing element 40.11 shoulders against the lower side of the mandrel retainer 40.13 which is threadably connected to the lower end of the bolt housing 40.14 and whose upper end shoulders against the outer housing 40.16 thus allowing the shock absorbing element 40.11 to absorb the shock between the outer housing 40.16 and the compression ring 40.17. The shock absorbing element 40.11 will permanently deform when absorbing the shock, releasing the absorbed energy in the form of heat.

Downward shocks are absorbed as follows: as the lower adapter 40.10 is loaded in the downward direction, the load is applied to the threadably connected transfer housing 40.9 and the element mandrel 40.8. The bottom side of the enlarged diameter 40.12 of the element mandrel 40.8 shoulders against the mandrel retainer 40.13 whose bottom side applies the load to the shock absorbing element 40.11. The bottom side of the shock absorbing element 40.11 rests on the compression ring 40.17 which shoulders against lower shoe 40.18. Since lower shoe 40.18 is threadably connected to outer housing 40.16, the shock absorbing element 40.11 can function to absorb a downward shock to the tool, permanently deforming when absorbing the shock.

Referring to FIGS. 5*a*–5*b*, a second embodiment of the shock absorber 40 in accordance with the present invention is illustrated.

In FIG. 5*a*, an upper adapter 40.20 is connected to a first outer housing 40.22. A recepter mount 40.24, adapted for receiving a detonating cord 40.1, is connected to an upper break plug support 40.26, the upper break plug support 40.26 receiving an upper end of the sectional break plug 40.6. The detonating cord 40.1 passes through the center of the upper break plug support 40.26 and through the center of the sectional break plug 40.6. The lower end of the sectional break plug 40.6 is disposed in a recess disposed in the upper end of a lower break plug support 40.28. The lower end of the lower break plug support 40.28 rests on the upper end of the element mandrel 40.30. A mandrel retainer 40.32 is disposed between the element mandrel 40.30 and the first outer housing 40.22, a top flange 30.1 of the element mandrel 40.30 resting on a top of the mandrel retainer 40.32. The mandrel retainer is not totally fixed in position; it is threadedly attached to a bolt housing 40.33 which is shouldered against the outer housing 40.22 in the upward direction but is free to move in the downward direction when the breakup plug 40.6 shatters. In FIGS. 5*a* and 5*b*, a crushable shock absorbing element 40.11 is disposed between the outer housing 40.22 and the element mandrel 40.30, and between the mandrel retainer 40.32 and a compression ring 40.34. When the shock is absorbed, the crushable element 40.11 will permanently deform, dissipating the absorbed energy in the form of heat. The lower element mandrel 40.30 is threadedly connected to an upper mandrel 40.36. The upper mandrel 40.36 is disposed within the first outer housing 40.22 and a piston housing 40.38. A lower mandrel 40.40 is disposed within the piston housing 40.38, and a piston 40.42 is threadedly attached to the upper mandrel 40.36 and the lower mandrel 40.40 and is movable longitudinally within the piston housing in response to a longitudinal movement of the upper and lower mandrels. O-rings seal an external circumference of the piston 40.42 to an internal surface of the piston housing 40.38. A piston retainer 40.44 connects a lower end of the lower mandrel 40.40 to a lower end of the piston housing 40.38. A lower perforating gun adaptor 40.46 is connected to the lower end of the lower mandrel 40.40. The detonating cord 40.1 passes through the center of: the upper break plug support 40.26, the sectional break plug 40.6, the lower break plug support 40.28, the element mandrel 40.30, the upper mandrel 40.36, the piston 40.42, the lower mandrel 40.40, and the gun adaptor 40.46. The detonating cord is ultimately connected to the perforating gun 22 for detonating the gun 22 in response to a detonation wave passing through the detonating cord 40.1.

A functional description of the second embodiment of the shock absorber 40 in accordance with the present invention will be set forth in the following paragraphs with reference to FIGS. 5*a*–5*b* of the drawings.

In FIG. 5*a*, as long as the sectional break plug 40.6 remains intact, the shock absorber 40 of FIGS. 5*a*–5*b* cannot absorb any shock; as a result, in the event a shock is received before the break plug 40.6 is shattered, the received shock will not be absorbed by the shock absorber 40 in FIGS. 5*a*–5*b*.

Assume that a detonation wave propagates downwardly in detonating cord 40.1 (although in other situations, it could propagate upwardly in the detonating cord); in that event, the detonation wave propagates through the upper break plug support 40.26, the sectional break plug 40.6, the lower break plug support 40.28, the element mandrel 40.30, the upper mandrel 40.36, the piston 40.42, the lower mandrel 40.40, and into the gun adaptor 40.46. When the detonation wave passes through the sectional break plug 40.6, all of the sections of the sectional break plug 40.6 shatter into a multitude of pieces. Now that the sectional break plug 40.6 has shattered, there is no longer any support member disposed between the lower break plug support 40.28 and the upper break plug support 40.26, and the shock absorber 40 of FIGS. 5a–5b is now free to absorb any received shock.

In FIG. 5b, since the detonation wave passed through the gun adaptor 40.46 to the perforating gun 22, the perforating gun 22 detonates, and a backward kick or upwardly directed shock results from the detonation of the gun 22. In response to the shock from the detonation of gun 22, the lower mandrel 40.40, piston 40.42, and upper mandrel 40.36 move upwardly in FIG. 5b relative to the piston housing 40.38. The uppermost end 36.1 of the upper mandrel 40,36 is in contact with the compression ring 40.34, the upward movement of the uppermost end 36.1 of the upper mandrel 40.36 moving the compression ring 40.34 upwardly. The mandrel retainer 40.32 in FIG. 5a remains fixed in its position shown in FIG. 5a, yet the element mandrel 40.30 and compression ring 40.34 move upwardly in response to the upward movement of the upper mandrel 40.36, and, since the sectional break plug 40.6 has already shattered in response to the detonation wave in the detonating cord 40.1 passing therethrough, there is nothing to prevent the lower break plug 40.28 from moving upwardly in response to the upward movement of the element mandrel 40.30. As a result, recalling that the crushable shock absorbing element 40.11 is disposed between the movable compression ring 40.34 and the mandrel retainer 40.32, the upward movement of compression ring 40.34 against the fixed position of the mandrel retainer 40.32 tends to compress and permanently deform the crushable shock absorbing element 40.11. The gradual crushing of the crushable shock absorbing element 40.11, in the same manner shown in U.S. Pat. No. 5,131,470 to Miszewski et al, results in absorption of the shock resultant from the detonation of the perforating gun 22.

Assume that a downwardly directed shock is received by the shock absorber 40 in FIGS. 5a–5b after the sectional break plug 40.6 has already shattered. In that event, the lower break plug support 40.28, element mandrel 40.30, compression ring 40.34, upper mandrel 40.36, piston 40.42, and lower mandrel 40.40 remain fixed in position; and upper adaptor 40.20, first outer housing 40.22, bolt housing 40.33, mandrel retainer 40.32, piston housing 40.38 and piston retainer 40.44 move downwardly in FIGS. 5a–5b. When the mandrel retainer 40.32 moves downwardly with respect to the compression ring 40.34, the crushable shock absorbing element 40.11 begins to crush and permanently deform when absorbing the received shock.

Referring to FIGS. 6a1, 6a2, and 6a3, a third embodiment of the shock absorber 40, in accordance with the present invention, is illustrated.

In FIG. 6a1, the shock absorber 40 includes a first, upper adaptor 40.50 having an internal bore, a detonating cord 40.1 disposed within and passing through the center of the internal bore of the upper adaptor 40.50. The upper adaptor 40.50 is threadedly and sealingly connected to an element mandrel 40.52 having an internal bore in which the detonating cord 40.1 is disposed. In FIG. 6a2, a cap 40.54 is disposed around and slidingly engaged with the element mandrel 40.52. A first compression ring 40.56 is disposed in contact with a bottom end of the cap 40.54 and in a recess or shoulder of the element mandrel 40.52. An element housing 40.58 is sealingly and threadedly connected to the cap 40.54 and a lock nipple 40.60. A lock mandrel 40.62 is disposed within and enclosed by the lock nipple 40.60, the lock mandrel 40.62 having an internal bore in which the detonating cord 40.1 is disposed. The lock mandrel 40.62 is fixed in position; however, the lock nipple 40.60 is slidingly engaged with the lock mandrel 40.62. In fact, the cap, element housing, lock nipples 40.54, 40.58, and 40.60, respectively, are adapted to slide longitudinally, upwardly and downwardly in FIG. 6a2, for purposes which will be described later in this specification. A second compression ring 40.64 rests on a top of the lock mandrel 40.62 and the lock nipple 40.60, the second compression ring 40.64 being adapted to move upwardly in FIG. 6a2 in response to an upward movement of the lock nipple 40.60. A crushable shock absorbing element 40.11, adapted to permanently deform when absorbing shock, is disposed in a space which exists between the element housing 40.58 and the element mandrel 40.52 and between the first compression ring 40.56 and the second compression ring 40.64. The first compression ring 40.56 is adapted to move downwardly in FIG. 6a2 in response to a downward movement of the cap 40.54, and the second compression ring 40.64 is adapted to move upwardly in FIG. 6a2 in response to an upward movement of the lock nipple 40.60; in either case, the crushable shock absorbing element 40.11 will be permanently deformed, absorbing the shock in either direction (e.g., resultant from detonation of the perforating gun 22) and releasing the absorbed shock energy in the form of heat, and not in the form of kinetic energy. A lock housing 40.66 is threadedly and sealingly connected to the lock nipple 40.60, a break up housing 40.68 (FIG. 6a3) is threadedly and sealingly connected to the lock housing 40.66, and a bottom gun adapter 40.70 is threadedly and sealing connected to the break up housing 40.68. In FIG. 6a2, a floating piston 40.74 is disposed within the lock housing 40.66. A piston 40.72 has a top part, a middle part, and a bottom part, the top part of piston 40.72 being disposed within the lock mandrel 40.62, the middle part of piston 40.72 being disposed within the floating piston 40.74, and the bottom part of piston 40.72 being disposed within the lock housing 40.66. A bottom end of the bottom part of piston 40.72 (FIG. 6a3) includes a flange 40.72-1 which is disposed within a shoulder 40.68-1 of the break up housing 40.68. A frangible, sectional break up element 40.6 is disposed within the break up housing 40.68, a top part of the break up element 40.6 being disposed within a recess defined by the flange 40.72-1 of the piston 40.72. The break up element 40.6 holds-up the piston 40.72 and prevents the piston 40.72 from moving downwardly as long as the break up element 40.6 is intact and has not shattered. As long as the break up element 40.6 is intact, the piston 40.72 cannot move downwardly in FIG. 6a3. However, when a detonation wave, propagating within detonating cord 40.1, passes through the frangible break up element 40.6, the break up element 40.6 shatters into a multitude of pieces; when the break up element 40.6 shatters, the piston 40.72, being slidable within the break up housing 40.68, the floating piston 40.74 and the lock mandrel 40.62, is free to move downwardly in FIG. 6a3. As noted above, when the break up element 40.6 shatters, the piston 40.72 is free to move downwardly. The piston 40.72 moves downwardly as follows. In FIG. 6a3, the lock housing 40.66 includes at least one pair of ports 40.66-1 transversely disposed through the wall of the lock housing 40.66. The piston 40.72 includes a first shoulder 72-5 disposed directly adjacent the ports 40.66-1 in the lock housing 40.66. When the shock absorber 40 in FIG. 6a3 is disposed in a wellbore, the rathole annulas pressure around the tool enters the ports 40.66-1 in FIG. 6a3 and is exerted on the first shoulder 72-5 of the piston 40.72. When the frangible break up element 40.6 shatters in response to a detonation wave passing therethrough, the annulus pressure being exerted on the first shoulder 72-5 tends to push the piston 40.72 downwardly in FIG. 6a3.

In FIG. 6a2, the piston 40.72 has a larger diameter section 72-2, a smaller diameter section 72-3, and a second shoulder 72-4 joining the larger and smaller diameter sections 72-2 and 72-3. In FIG. 6a2, a locking dog 40.76 is disposed between the larger diameter section 72-2 of piston 40.72, on one side, and the lock housing 40.66 on the other side. On said other side, the locking dog 40.76 actually rests is a recess defined by the lock housing 40.66 and lock nipple 40.60.

In FIGS. 9 and 10, a larger sectional view of the second shoulder 72-4 Joining the larger diameter section 72-2 and smaller diameter section 72-3 of piston 40.72, the locking dog 40.76, and the recess defined by the lock housing 40.66 and the lock nipple 40.60 is illustrated.

In FIG. 9, the locking dog 40.76 is seen disposed between the larger diameter section 72-2 of piston 40.72, on the one side, and the recess defined by the lock housing 40.66 and lock nipple 40.60, on the other side.

However, in FIG. 10, when the piston 40.72 moves downwardly in response to the annulus pressure being exerted on the first shoulder 72-5, the locking dog 40.76 is urged inwardly, out of its recess, by the chamfer on the locking dog and either the annular shoulder of the lock housing 40.66 or the chamfer on the lock nipple 40.60, the locking dog coming to rest adjacent the smaller diameter section 72-3 of piston 40.72 directly above the second shoulder 72-4. Now, since the locking dog 40.76 is no longer disposed within the recess (defined by the lock housing 40.66 and lock nipple 40.60), the locking housing 40.66 and lock nipple 40.60 are free to move upwardly and downwardly in FIG. 10.

In FIG. 6a3, as noted above, one end of the sectional break up element 40.6 is disposed within the recess defined by flange 40.72-1 of piston 40.72. A break up holder 40.78 supports the other end of the sectional break up element 40.6. The bottom gun adaptor 40.70 holds the break up holder 40.78 in place. A detonating cord 40.1 passes through the center of the entire shock absorber shown in FIGS. 6a1–6a3 on its way for connection to the perforating gun 22.

FIG. 7 illustrates a cross section of the shock absorber in FIG. 6a2 taken along section lines 7—7 of FIG. 6a2.

FIG. 8 illustrates a cross section of the shock absorber in FIG. 6a2 taken along section lines 8—8 of FIG. 6a2.

A functional description of the third embodiment of the shock absorber of the present invention shown in FIGS. 6al-6a3 will be set forth in the following paragraphs with reference to FIGS. 6b1–6b3, 6c1–6c3, and 6d1–6d3 of the drawings.

In FIG. 6b1–6b3, a detonation wave propagates within detonating cord 40.1, passing through the element mandrel 40.52, the lock mandrel 40.62, the piston 40.72, the frangible sectional break up element 40.6, the break up holder 40.78, and the bottom gun adaptor 40.70, the detonation wave eventually propagating to the perforating gun 22 and detonating the gun. When the detonation wave in detonating cord 40.1 passes through the sectional break up element 40.6, the entire sectional break up element 40.6 shatters into a multitude of pieces, as indicated in FIG. 663. At this point, the break up element 40.6 is no longer supporting the piston 40.72. The rathole annulus pressure is exerted onto the first shoulder 72-5 of piston 40.72 in FIG. 6b3. As a result of the pressure acting on the first shoulder 72-5, the piston 40.72 moves downwardly in FIG. 663. Referring to FIG. 6b2, since the piston 40.72 is moving downwardly, the second shoulder 72-4 of piston 40.72 moves past the locking dogs 40.76 which allows the locking dogs 40.76 to move inwardly, the locking dogs 40.76 then being disposed adjacent the smaller diameter section 72-3 of the piston 40.72 directly above the second shoulder 72-4 (best seen in FIG. 10). Since the frangible break up element 40.6 has shattered and the locking dogs 40.76 moved out of their recess (best seen in FIG. 10), there is nothing to prevent the bottom gun adaptor 40.70, the break up housing 40.68, the lock housing 40.66, the lock nipple 40.60 and second compression ring 40.64 from moving upwardly in FIGS. 6b2 and 6b3 in response to an upwardly directed shock; and there is nothing to prevent the cap 40.54, first compression ring 40.56, the element housing 40.58, lock nipple 40.60, lock housing 40.66, break up housing 40.68 and bottom gun adaptor 40.70 from moving downwardly in FIGS. 6b2 and 6b3 in response to a downwardly directed shock.

In FIG. 6c1–6c3, the shock absorber 40 is shown in its condition after an upwardly directed shock has been absorbed.

In FIGS. 6c1–6c3, an upwardly directed shock has been absorbed by shock absorber 40 in response to a detonation of perforating gun 22. As a result, the following parts of the shock absorber 40 have moved upwardly in response to the shock: the bottom gun adaptor 40.70, the break up housing 40.68, the lock housing 40.66, the lock nipple 40.60, the second compression ring 40.64, the element housing 40.58, and the cap 40.54. In response to the upward movement of the lock nipple 40.60, the second compression ring 40.64 also moves upwardly. The upward movement of the second compression ring 40.64 relative to the stationary location of the first compression ring 40.56 compresses the crushable shock absorbing element 40.11, the shock absorbing element 40.11 permanently deforming in response to its compression and releasing the absorbed energy in the form of heat. In FIG. 6c2, the shock absorbing element 40.11 is shown in its permanently deformed condition.

In FIGS. 6d1–6d3, the shock absorber 40 is shown in its condition after a downwardly directed shock has been absorbed.

In FIGS. 6d1–6d3, a downwardly directed shock has been absorbed by the shock absorber 40. As a result, the following parts have moved downwardly in response to the shock: the cap 40.54, first compression ring 40.56, the element housing 40.58, lock nipple 40.60, lock housing 40.66, break up housing 40.68 and bottom gun adaptor 40.70. In response to the downward movement of the first compression ring 40.56 relative to the stationary location of the second compression ring 40.64, the crushable shock absorbing element 40.11 undergoes compression. In response to the compression, the shock absorbing element 40.11 permanently deforms and it releases the absorbed shock energy in the form of heat. In FIG. 6d2, the shock absorbing element 40.11 is shown in its permanently deformed condition.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Apparatus for absorbing a shock, comprising:

a frangible element having a hollow interior;

a detonating cord disposed within the hollow interior of said frangible element and adapted for conducting a detonation wave, said frangible element adapted to shatter when said detonation wave conducts in said detonating cord and passes through said frangible element; and a crushable element adapted for receiving a shock and for permanently deforming in response to said shock when said frangible element shatters, said shock being absorbed when said crushable element deforms in response to receipt of said shock.

2. The apparatus of claim 1, further comprising:

piston means responsive to an applied pressure for moving in a longitudinal direction, said piston having a smaller diameter section and a larger diameter section disposed adjacent said smaller diameter section;

locking means initially disposed adjacent said larger diameter section of said piston means for preventing said shock from being absorbed when disposed adjacent said larger diameter section of said piston means and for moving into disposition adjacent said smaller diameter section of said piston means and allowing said shock to be absorbed when disposed adjacent said smaller diameter section of said piston means but only after said piston means moves in said longitudinal direction in response to said applied pressure, said crushable element deforming in response to receipt of said shock only after said locking means moves into disposition adjacent said smaller diameter section of said piston means.

3. The apparatus of claim 2, wherein said locking means comprises a locking dog initially disposed between said larger diameter section of said piston means and a recess, said locking dog moving out of said recess and into disposition adjacent said smaller diameter section of said piston means when said piston means moves in said longitudinal direction in response to said applied pressure, said locking dog preventing said shock from being absorbed when disposed between said larger diameter section of said piston means and said recess, said locking dog allowing said shock to be absorbed when moved into disposition adjacent said smaller diameter section of said piston means, said crushable element deforming and absorbing said shock when said frangible element shatters and said locking dog allows said shock to be absorbed.

4. A method for absorbing a shock, comprising the steps of:

propagating a detonation wave through a detonating cord, said detonating cord being disposed within a frangible member;

shattering said frangible member when said detonation wave in said detonating cord passes through said frangible member;

receiving a shock in a shock absorption member only after said frangible member shatters; and absorbing said shock when said shock is received in said shock absorption member.

5. The method of claim 4, wherein the receiving step comprises the steps of:

moving a piston;

further moving a locking means out of a recess in response to movement of said piston; and receiving said shock in said shock absorption member only after said frangible member shatters and said locking means moves out of said recess.

6. The method of claim 4, wherein said shock absorption member comprises a crushable element adapted to permanently deform when absorbing said shock, the receiving step comprising the steps of:

receiving said shock in said crushable element only after said frangible member shatters, said crushable element permanently deforming when absorbing said shock.

7. The method of claim 6, wherein the receiving step comprises the steps of:

moving a piston;

further moving a locking means out of a recess in response to movement of said piston; and receiving said shock in said crushable element only after said frangible member shatters and said locking means moves out of said recess.

8. Apparatus adapted to be disposed in a wellbore for absorbing a shock, comprising:

frangible means responsive to a stimulus for shattering in response to said stimulus, said frangible means including a frangible apparatus having a hollow interior, and a detonating cord adapted for conducting a detonation wave disposed within the hollow interior of said frangible apparatus, said frangible apparatus shattering when said detonation wave conducting in said detonating cord passes through the hollow interior of said frangible apparatus; and absorption means responsive to said shock for absorbing said shock but only after said frangible apparatus shatters.

9. The apparatus of claim 8, wherein said stimulus is said detonation wave propagating in said detonating cord, said frangible apparatus shattering when said detonation wave representing said stimulus conducting in said detonating cord passes through said frangible apparatus.

10. The apparatus of claim 8, wherein said absorption means comprises crushable means responsive to receipt of said shock for crushing in response to said shock but only after said frangible apparatus shatters.

11. The apparatus of claim 10, wherein said frangible apparatus comprises a frangible tube adapted for enclosing said detonating cord, said crushable means including a crushable shock absorbing element adapted to permanently deform when absorbing shock, said frangible tube shattering when said detonation wave propagating in said detonating cord passes through said frangible tube, said crushable shock absorbing element permanently deforming in response to said shock when said frangible tube shatters.

12. The apparatus of claim 8, wherein an annulus exists between said apparatus and a wall of said wellbore when said apparatus is disposed in said wellbore, a predetermined pressure adapted to exist within said annulus, further comprising:

shock absorption prevention means for preventing said shock from being absorbed by said absorption means before said frangible apparatus shatters and allowing said shock to be absorbed by said absorption means in response to said predetermined pressure in said annulus after said frangible apparatus shatters.

13. The apparatus of claim 12, wherein said shock absorption prevention means comprises a locking dog, said locking dog being disposed between a recess and a larger diameter section of a piston after said frangible apparatus shatters but before said predetermined pressure exists in said annulus, said locking dog falling out of said recess and into adjacent disposition with a smaller diameter section of said piston after said frangible apparatus shatters and after said predetermined pressure exists in said annulus.

14. The apparatus of claim 13, wherein said absorption means comprises crushable means responsive to receipt of said shock for crushing in response to said shock but only after said frangible apparatus shatters.

15. The apparatus of claim 14, wherein said frangible apparatus comprises a frangible tube adapted for enclosing said detonating cord, said crushable means including a crushable shock absorbing element adapted to permanently deform when absorbing shock, said frangible tube shattering when said detonation wave propagating in said detonating cord passes through said frangible tube, said crushable shock absorbing element permanently deforming in response to said shock after said frangible tube shatters.

16. A shock absorber adapted to be disposed in a wellbore for absorbing a shock, comprising:

shock absorbing means for absorbing said shock;

a frangible apparatus having a hollow interior; and a detonating cord adapted for conducting a detonation wave and disposed within the hollow interior of said frangible apparatus, said frangible apparatus shattering when said detonation wave conducting in said detonating cord passes through the hollow interior of said frangible apparatus, said shock absorbing means absorbing said shock but only after said frangible apparatus shatters.

17. The shock absorber of claim 16, wherein said frangible apparatus comprises a cast iron material.

18. The shock absorber of claim 17, wherein said cast iron material comprises a ductile iron material.

19. The shock absorber of claim 16, wherein said shock absorbing means further comprises:

crushable shock absorbing means responsive to the shattering of said frangible apparatus and to a subsequent receipt of said shock for crushing and permanently deforming in response to said shock.

20. Wellbore apparatus adapted to be disposed in a wellbore for preventing and allowing a shock to be absorbed, comprising:

a shock absorber adapted to absorb a shock; and shock absorption prevention means for preventing said shock from being absorbed, said shock absorption prevention means including, a frangible apparatus having a hollow interior, and a detonating cord adapted for conducting a detonation wave and disposed within the hollow interior of said frangible apparatus, said frangible apparatus remaining intact and preventing said shock from being absorbed by said shock absorber when said detonation wave does not conduct in said detonating cord and said detonation wave does not pass through the hollow interior of said frangible apparatus, said frangible apparatus shattering and allowing said shock to be absorbed by said shock absorber when said detonation wave conducts in said detonating cord and said detonation wave passes through the hollow interior of said frangible apparatus.

21. The wellbore apparatus of claim 20, wherein an annulus exists between said wellbore apparatus and a wall of said wellbore when said wellbore apparatus is disposed in said wellbore, a predetermined pressure adapted to exist within said annulus, and wherein said shock absorption prevention means further comprises:

a locking dog disposed between a recess and a larger diameter section of a piston thereby preventing said shock from being absorbed by said shock absorber after said frangible apparatus shatters but before said predetermined pressure exists in said annulus, said locking dog falling out of said recess and into adjacent disposition with a smaller diameter section of said piston thereby allowing said shock to be absorbed by said shock absorber after said frangible apparatus shatters and in response to said predetermined pressure existing in said annulus.

* * * * *